US008769909B2

(12) United States Patent
McNamee

(10) Patent No.: US 8,769,909 B2
(45) Date of Patent: Jul. 8, 2014

(54) PANEL CAPTURE FRAME

(71) Applicant: Steve V. McNamee, Argusville, ND (US)

(72) Inventor: Steve V. McNamee, Argusville, ND (US)

( * ) Notice: Subject to any disclaimer, the term of this patent is extended or adjusted under 35 U.S.C. 154(b) by 0 days.

(21) Appl. No.: 13/768,667

(22) Filed: Feb. 15, 2013

(65) Prior Publication Data

US 2013/0152501 A1 Jun. 20, 2013

Related U.S. Application Data

(62) Division of application No. 12/816,839, filed on Jun. 16, 2010.

(51) Int. Cl.

| | |
|---|---|
| ***E04C 2/38*** | (2006.01) |
| ***E04B 1/61*** | (2006.01) |
| ***E04C 2/54*** | (2006.01) |
| ***E04B 5/04*** | (2006.01) |
| ***F16B 21/08*** | (2006.01) |
| ***F16D 1/00*** | (2006.01) |

(52) U.S. Cl.
USPC ..... 52/656.9; 52/578; 52/581; 52/584.1; 52/656.8; 52/282.1; 52/770; 52/780; 52/597; 52/204.62; 403/397; 403/329

(58) Field of Classification Search
USPC ..... 52/578, 581, 582.1, 584.1, 656.8, 52/656.9, 582.2, 282.1, 770, 780, 781, 52/455, 457–460, 204.593, 591, 597, 52/204.62; 403/397, 329, DIG. 7
See application file for complete search history.

(56) References Cited

U.S. PATENT DOCUMENTS

| | | | | |
|---|---|---|---|---|
| 1,540,788 | A | | 10/1924 | McClure |
| 2,111,448 | A | | 9/1935 | Hoffman |
| 2,394,443 | A | * | 2/1946 | Guignon, Jr. ..... 52/580 |
| 2,976,969 | A | * | 3/1961 | Gillespie ..... 52/464 |
| 3,184,013 | A | * | 5/1965 | Pavlecka ..... 52/275 |
| 3,222,841 | A | | 12/1965 | Lipof |
| 3,267,631 | A | * | 8/1966 | Hammitt ..... 52/771 |
| 3,303,626 | A | * | 2/1967 | Brigham ..... 52/717.05 |
| 3,380,210 | A | * | 4/1968 | Neal et al. ..... 52/235 |
| 3,381,434 | A | * | 5/1968 | Carson ..... 52/204.591 |
| 3,554,383 | A | | 1/1971 | Ball |
| 3,574,985 | A | * | 4/1971 | Pierce ..... 52/463 |

(Continued)

OTHER PUBLICATIONS

Office Actions and responses for corresponding U.S. Appl. No. 12/816,839.

*Primary Examiner* — Phi A
*Assistant Examiner* — Omar Hijaz
(74) *Attorney, Agent, or Firm* — Westman, Champlin & Koehler, P.A.; Theodore M. Magee

(57) ABSTRACT

A frame for a panel is constructed from two frame components. One of the frame components has a first wall and a first channel and the second frame component has a second wall and a second channel. The first frame component is mated to the second frame component with the first wall of the first frame component inserted in and making frictional contact with the second channel of the second frame component and the second wall of the second frame component inserted in and making frictional contact with the first channel of the first frame component. Portions of the panel are held between and make contact with the first frame component and the second frame component such that an end of the panel is located within a chamber defined between the first frame component and the second frame component.

14 Claims, 13 Drawing Sheets

(56) References Cited

U.S. PATENT DOCUMENTS

| | | | | | |
|---|---|---|---|---|---|
| 3,688,460 | A | * | 9/1972 | Van Loghem et al. | 52/466 |
| 3,732,659 | A | * | 5/1973 | LaBarge | 52/461 |
| 3,738,083 | A | * | 6/1973 | Shimano | 52/584.1 |
| 3,789,567 | A | * | 2/1974 | Rae et al. | 52/584.1 |
| 3,815,311 | A | | 6/1974 | Nisula et al. | |
| 4,127,156 | A | | 11/1978 | Brandt | |
| 4,184,297 | A | * | 1/1980 | Casamayor | 52/202 |
| 4,270,333 | A | | 6/1981 | Singer et al. | |
| 4,282,695 | A | | 8/1981 | Lew | |
| 4,286,630 | A | * | 9/1981 | Happer | 138/92 |
| 4,455,807 | A | * | 6/1984 | Ehrlich | 52/770 |
| 4,539,243 | A | * | 9/1985 | Miller | 428/99 |
| 4,648,231 | A | * | 3/1987 | Laroche | 52/775 |
| 4,707,894 | A | * | 11/1987 | Friedwald | 24/459 |
| 4,750,310 | A | * | 6/1988 | Holcombe | 52/844 |
| 4,968,171 | A | * | 11/1990 | Shell | 403/4 |
| 4,987,717 | A | | 1/1991 | Dameron, Jr. | |
| 5,031,083 | A | * | 7/1991 | Claesson | 362/249.06 |
| 5,325,649 | A | * | 7/1994 | Kajiwara | 52/586.1 |
| 5,546,713 | A | * | 8/1996 | Voegele et al. | 52/202 |
| 5,655,346 | A | * | 8/1997 | Holmes et al. | 52/476 |
| 5,678,383 | A | * | 10/1997 | Danielewicz | 52/775 |
| 5,791,810 | A | * | 8/1998 | Williams | 403/364 |
| 6,345,480 | B1 | * | 2/2002 | Kemper et al. | 52/395 |
| 6,588,165 | B1 | * | 7/2003 | Wright | 52/506.05 |
| 7,562,504 | B2 | * | 7/2009 | Herbst et al. | 52/461 |
| 7,877,962 | B2 | | 2/2011 | Teffenhart, Jr. | |
| 8,146,317 | B1 | * | 4/2012 | Fletcher et al. | 52/582.2 |
| 2009/0146454 | A1 | * | 6/2009 | Riley et al. | 296/186.1 |

* cited by examiner

PANEL CAPTURE FRAME

CROSS-REFERENCE TO RELATED APPLICATION

The present application is a divisional of and claims priority of U.S. patent application Ser. No. 12/816,839, filed Jun. 16, 2010, the content of which is hereby incorporated by reference in its entirety.

BACKGROUND OF THE INVENTION

In architectural design, framed panels are often used to provide a decorative appearance to walls, ceilings, and railing systems. The panels may be solid, perforated or mesh and may be constructed from a number of different materials such as metal, plastic or glass. The frames around the panels hold the panels in place and often include additional structural elements that allow the frames to be mounted to part of a building.

SUMMARY OF THE INVENTION

A frame for a panel is constructed from two frame components. One of the frame components has a first wall and a first channel and the second frame component has a second wall and a second channel. The first frame component is mated to the second frame component with the first wall of the first frame component inserted in the second channel of the second frame component and the second wall of the second frame component inserted in the first channel of the first frame component. Portions of the panel are held between and make contact with the first frame component and the second frame component such that an end of the panel is located within a chamber defined between the first frame component and the second frame component. The first frame component and the second frame component remain connected together based on the contact between the second wall and sides of the first channel and the first wall and the sides of the second channel.

DETAILED DESCRIPTION OF ILLUSTRATIVE EMBODIMENTS

Figure 1:
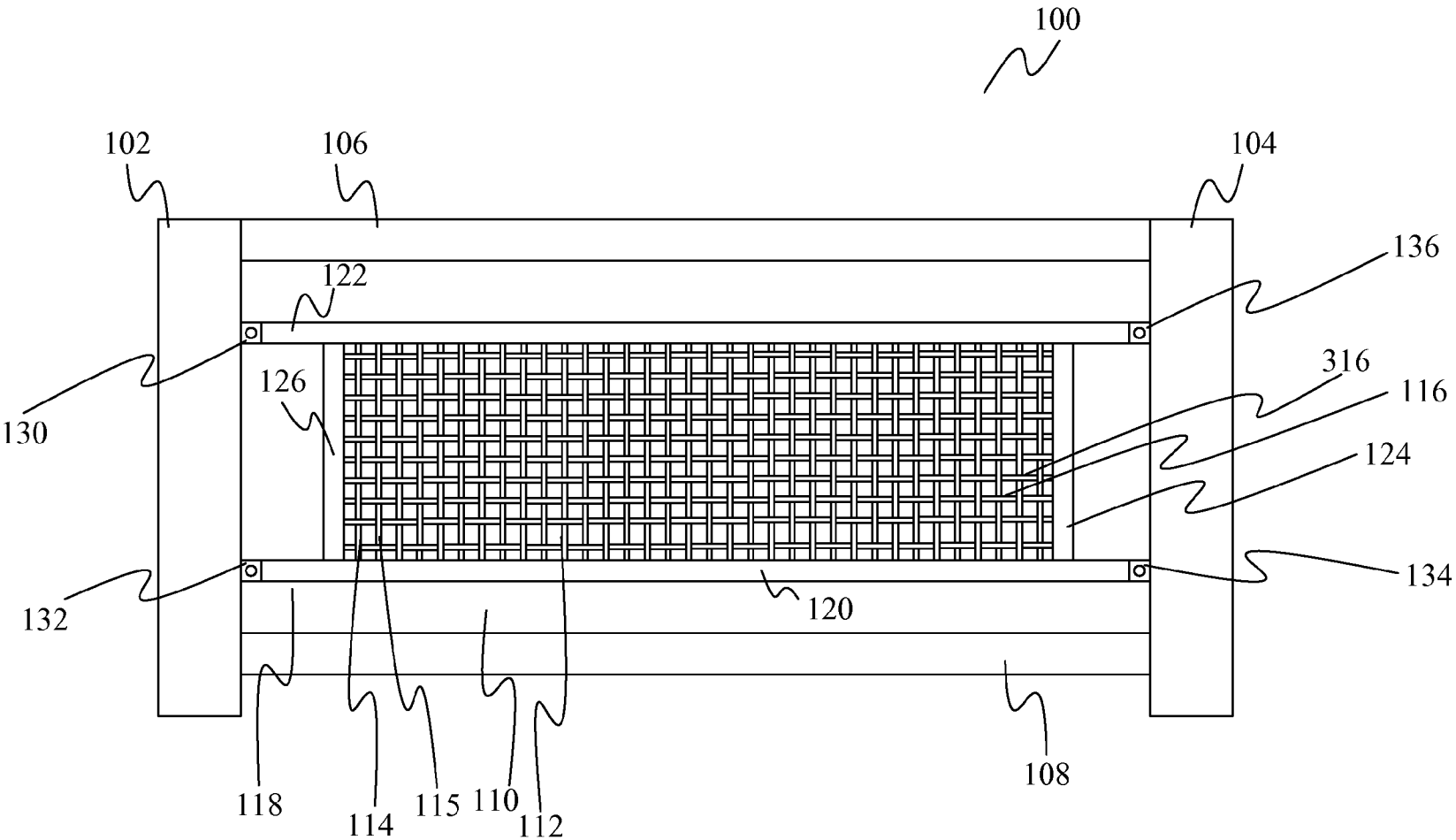
FIG. 1 is a front view of a framed mesh panel installed in a railing system.

FIG. 1 provides a front view of a framed panel 110. In FIG. 1, framed panel 110 is mounted to a railing system 100. Railing system 100 is simply one example of a location where a framed panel may be mounted. Other possible locations include ceilings, walls and facades, for example.

Railing system 100 includes two posts 102 and 104, a top railing 106 and a bottom railing 108. Framed panel 110 includes a mesh panel 112 formed of a first set of strands such as vertical strands 114 and 115 and a second set of strands such as horizontal strands 116 and 316 that cross each other. In the embodiment shown in FIG. 1, the vertical strands and horizontal strands are shown as being woven together. However, such weaving is not necessary. Further, in other embodiments, only the vertical strands or only the horizontal strands may be present. Framed panel 110 also includes a frame 118 that comprises horizontal frame members 120 and 122 and vertical frame members 124 and 126. Frame members 120, 122, 124, and 126 each accept and contain the ends of strands from mesh panel 112. Under one embodiment, vertical members 124 and 126 are welded to horizontal members 120 and 122 and horizontal members 120 and 122 are bolted to posts 102 and 104 through brackets 130, 132, 134, and 136, which are welded to posts 102 and 104.

Figure 2:
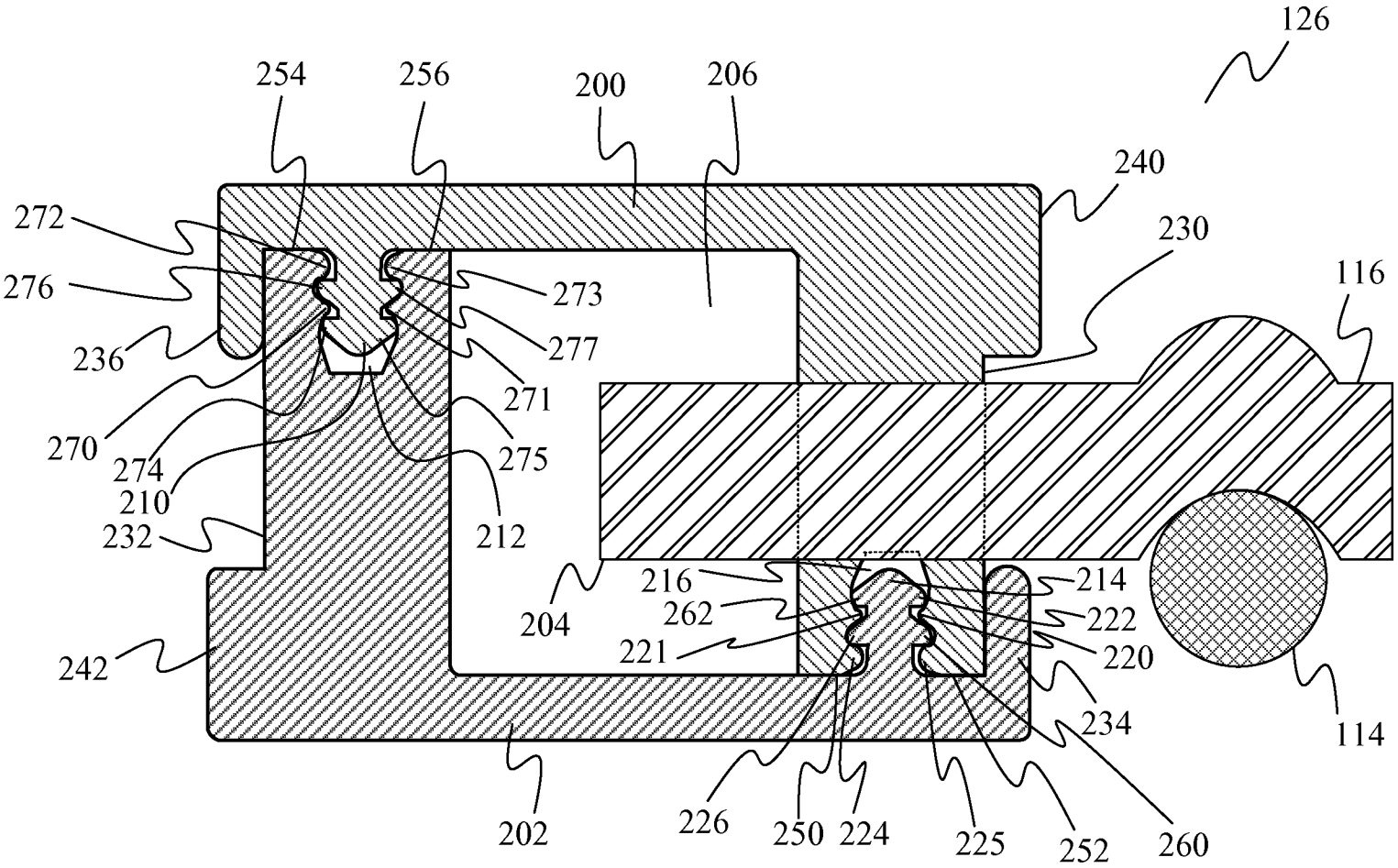
FIG. 2 is a cross-sectional view of a portion of a frame and panel under one embodiment.

FIG. 2 provides a cross-sectional side view of vertical frame member 126 showing horizontal strand 116 and vertical strand 114. Vertical frame member 126 includes front frame component 200 and back frame component 202. An end 204 of strand 116 is located within a chamber 206 formed between front frame component 200 and back frame component 202. Front frame component 200 is latched to back frame component 202 through the interaction of a shaped wall or tongue 210 of front frame component 200 and the side walls of a channel 212 of back frame component 202 as well as the interaction of a shaped wall or tongue 214 of back frame component 202 with the side walls defining channel 216 in front frame component 200. Under one embodiment, shaped walls or tongues 210 and 214 have a "Christmas tree" cross-sectional shape and channels 212 and 216 have "Christmas tree" cut-out shapes. In particular, the channels 212 and 216 provide ribbed portions that are in frictional contact with the bottom of flared portions of the shaped tongues or walls 210 and 214. For example, channel 216 is defined in part by ribbed portions 220, 221, 224 and 225, which are in frictional contact with flared portions 222, 262, 226, and 260, respectively, of wall 214. Similarly, channel 212 is defined in part by ribbed portions 270, 271, 272 and 273, which are in frictional contact with flared portions 274, 275, 276, and 277, respectively of wall 210. The frictional contact between the flared portions and the ribbed portions keep the wall sections within the respective channels, thereby latching front frame component 200 to back frame component 202.

Channel 216 is formed within a strut 230 and channel 212 is formed within a strut 232. A lip 234 of back frame component 202 extends over strut member 230 and a lip 236 of front frame component 200 extends over strut member 232. A shoulder 240 extends from strut member 230 of frame component 200. A similar shoulder 242 extends from strut member 232 of frame component 202. Shoulders 240 and 242 are optional and may not be present in all embodiments. The ends 250 and 252 of strut 230 are in direct contact with an interior surface of frame component 202. Similarly, the ends 254 and 256 of strut 232 are in direct contact with an interior surface of frame component 200.

Figure 3:
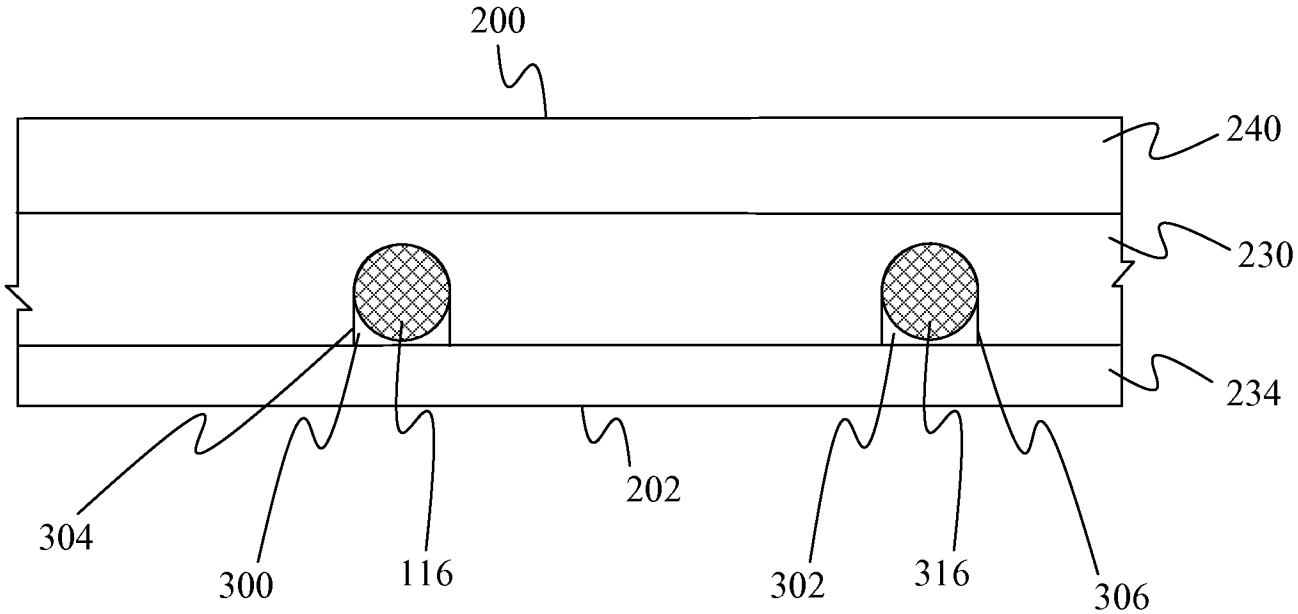
FIG. 3 is an exterior bottom view of the frame and panel of FIG. 2.

FIG. 3 provides a bottom view of frame 126 and shows strut member 230 and shoulder 240 of frame component 200 as well as lip 234 of framed component 202. Mesh strand 116 and an additional mesh strand 316 are shown in cross-section. Mesh strand 116 is shown as passing through an opening 300 and mesh strand 316 is shown as passing through an opening 302. Opening 300 is defined by the perimeter of a notch 304 and the edge of lip 234. Opening 302 is defined by the perimeter of a notch 306 and the edge of lip 234.

Notches 304 and 306 are cut to accommodate the size and shape of strands 116 and 316. For larger strands, larger notches will be cut into strut 230 and for smaller strands, smaller notches will be cut into strut 230. Further, although strands 116 and 316 are shown as having a circular cross-sectional shape, other cross-sectional shapes may be possible, including any desired polygonal shape. For such shapes, the notches may be milled to match the shape of the strand.

Frame members 120, 122, and 124 have a similar construction to frame member 126. As such, frame member 120 is constructed of a third frame component mated to a fourth frame component to form a second chamber; frame member 122 is constructed of a fifth frame component mated to a sixth frame component to form a third chamber; and frame 124 is constructed of a seventh frame component mated to an eighth frame component to form a fourth chamber. Further, frame components 200 and 202 are welded to the third and fourth frame components of frame member 120 and the fifth and sixth frame components of frame member 122. Similarly, the seventh and eighth frame components of frame member 124 are welded to the third and fourth frame components of frame member 120 and the fifth and sixth frame components of frame member 122. Each strand in the second set of strands has one end in the second chamber and one end in the third chamber and each strand in the first set of strands has one end in fourth chamber and one end in chamber 206.

Figure 4:
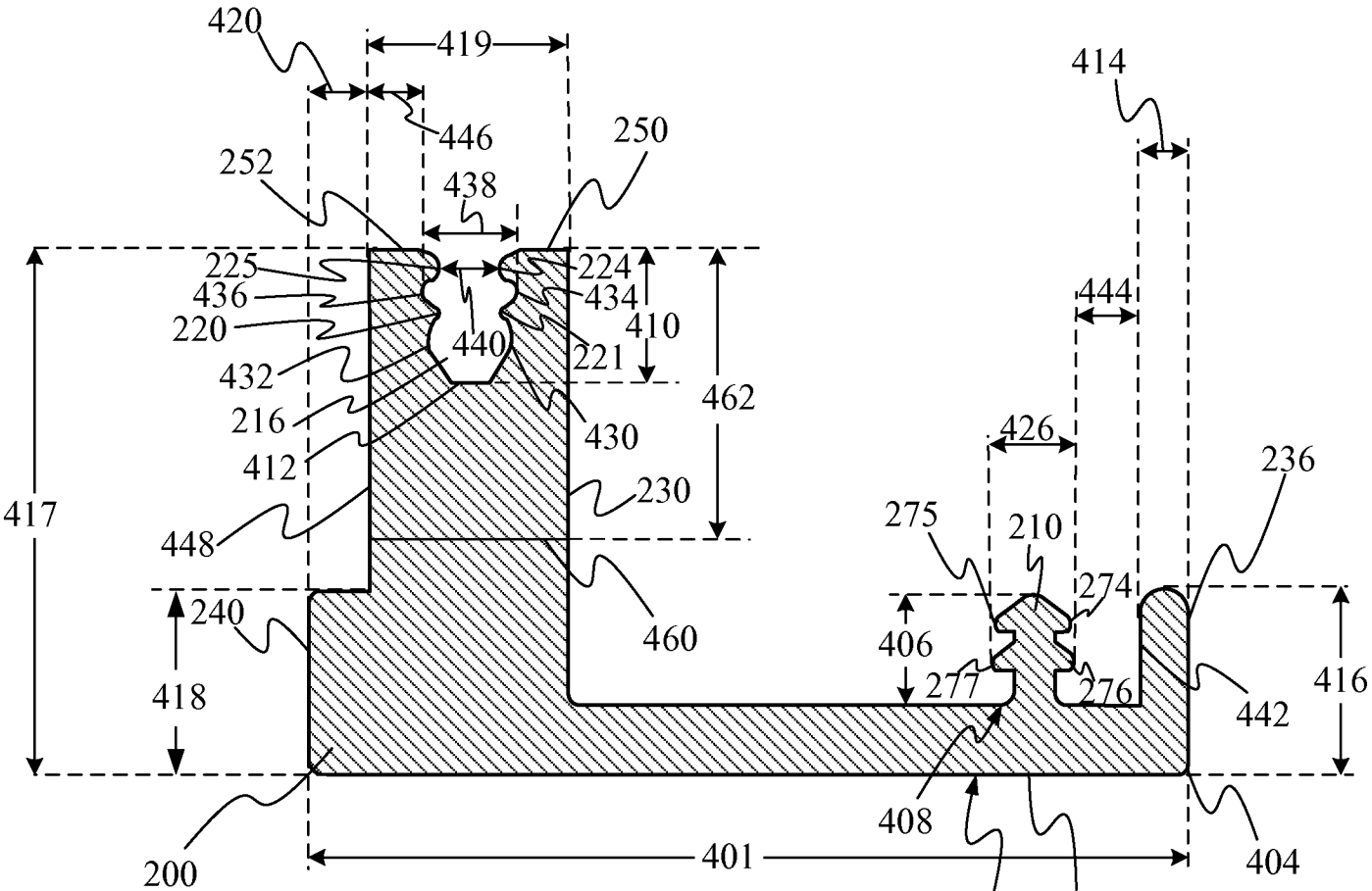
FIG. 4 is a cross-sectional side view of a frame component under one embodiment.

FIG. 4 shows a cross-sectional side view of frame component 200 in isolation.

As shown in FIG. 4, frame component 200 includes a face plate 400 having an exterior surface 402 with lip 236 extending from the face plate at a first end 404 of the face plate. Face plate 400 has a width 401, which under one embodiment, is equal to 1 5/32 inches.

Lip 236 extends in a direction opposite the exterior surface 402. Shaped wall 210 extends from face plate 400 in the same direction as lip 236 and has a top that is a height 406 above a point 408 from which the shaped wall extends. Strut 230 extends from face plate 400 in the same direction as shaped wall 210 and has ends 250 and 252 opposite face plate 400. Channel 216 defined between ends 250 and 252 of strut 230 has a depth 410 from the bottom 412 of channel 216 to the surface of ends 250 and 252 of strut 230 that is at least as great as the height 406 of the shaped wall 210. Under one embodiment, height 406 is 5/32 inch and depth 410 is 3/16 inch, for example.

Lip 236 has a width 414 and extends a height 416 from exterior surface 402. Under one embodiment, width 414 is 1/16 inch and height 416 is 15/64 inch, for example. Strut 230 extends a distance 417 from exterior surface 402 with shoulder 240 extending a distance 418 from exterior surface 402. Under one embodiment, distance 417 is 11/16 inch and distance 418 is 15/32 inch. Strut 230 has a width 419 and shoulder 240 extends an additional width 420. Under one embodiment, width 419 is 1/4 inch and additional width 420 is 5/64 inch, for example.

Shaped wall 210 includes flared portions 422, 423, 424, and 425. Flared portions 422 and 423 are at a same height from surface 408 and flared portions 424 and 425 are at a same height from surface 408. Under one embodiment, a width 426 between the outer extents of flared portions 424 and 425 is 7/64 inch. Under some embodiments, the distance between the exterior extents of flared portions 422 and 423 is equal to width 426. In other embodiments, the distance between the exterior extents of flared portions 422 and 423 is less than width 426.

Channel 216 is shaped to include flared cutouts 430, 432, 434, and 436. Under some embodiments, a distance 438 between the walls defining flared cutout 434 and flared cutout 436 is equal to distance 426 between the extents of flare 424 and flare 425. The distance 440 between ribs 224 and 225 of channel 216 is smaller than distance 438 such that channel 216 is narrower at a point further from bottom 412 of channel 216 than at a point closer to bottom 412 of channel 216.

A lateral distance 444 between an interior facing surface 442 of lip 236 and a surface of flared portion 425 is equal to or smaller than a lateral distance 446 from an exterior sidewall 448 of strut 230 to the wall defining flared cutout 436 of channel 216. Under some embodiments, lateral distance 444 is 11/128 inch and lateral distance 446 9/128 inch.

In FIG. 4, an end 460 of a cutout or notch in strut 230 is located a distance 462 from end 250 of strut 230. Under one embodiment, distance 462 is 27/64 inch.

The elements and dimensions described for frame component 200 are also found in frame component 202 with the possible exception of cutouts/notches 304 and 306. In some embodiments, frame component 202 will include such notches and in other embodiments frame component 202 will not include notches. Thus, frame component 200 and frame component 202 have identical cross-sectional shapes in at least the areas without notches.

Figure 5:
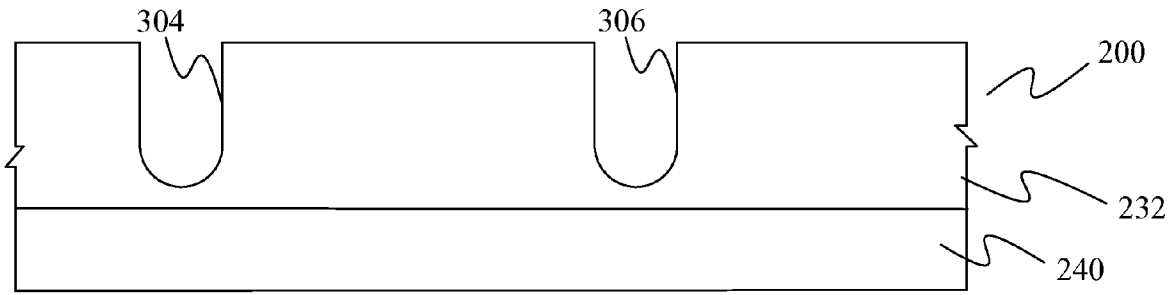
FIG. 5 is a bottom view of the frame component of FIG. 4.
Figure 6:
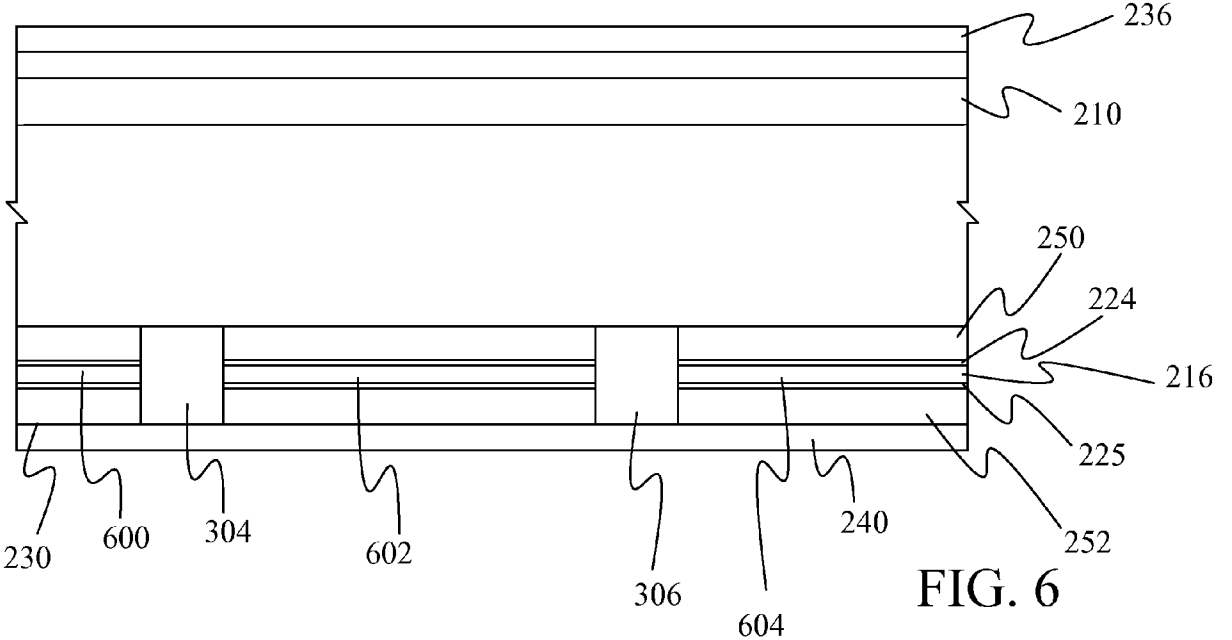
FIG. 6 is a back-view of the frame component of FIG. 4.

FIG. 5 shows a bottom view of frame component 200 without frame component 202 and without strands 116 and 316. FIG. 5 more clearly shows the shape of notches 304 and 306. FIG. 6 shows a back view of frame component 200 showing lip 236, shaped wall 210, strut ends 250 and 252, channel 216, and ribs 224 and 225. In FIG. 6, cutouts 304 and 306 pass through the entire width of strut 230 and separate channel 216 into a plurality of channel segments such as channel segments 600, 602, and 604.

Figure 7:
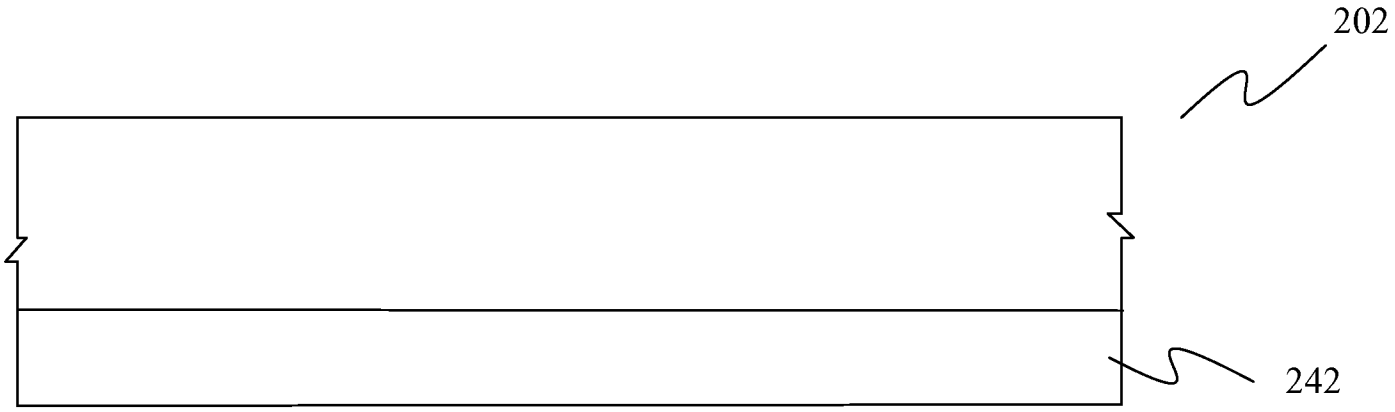
FIG. 7 is a bottom view of a frame component of the frame of FIG. 2 without notches.

FIG. 7 shows a top view of frame component 202 showing shoulder 242 wherein the embodiment of FIG. 7 provides a frame component without any cutouts or notches.

Figure 8:
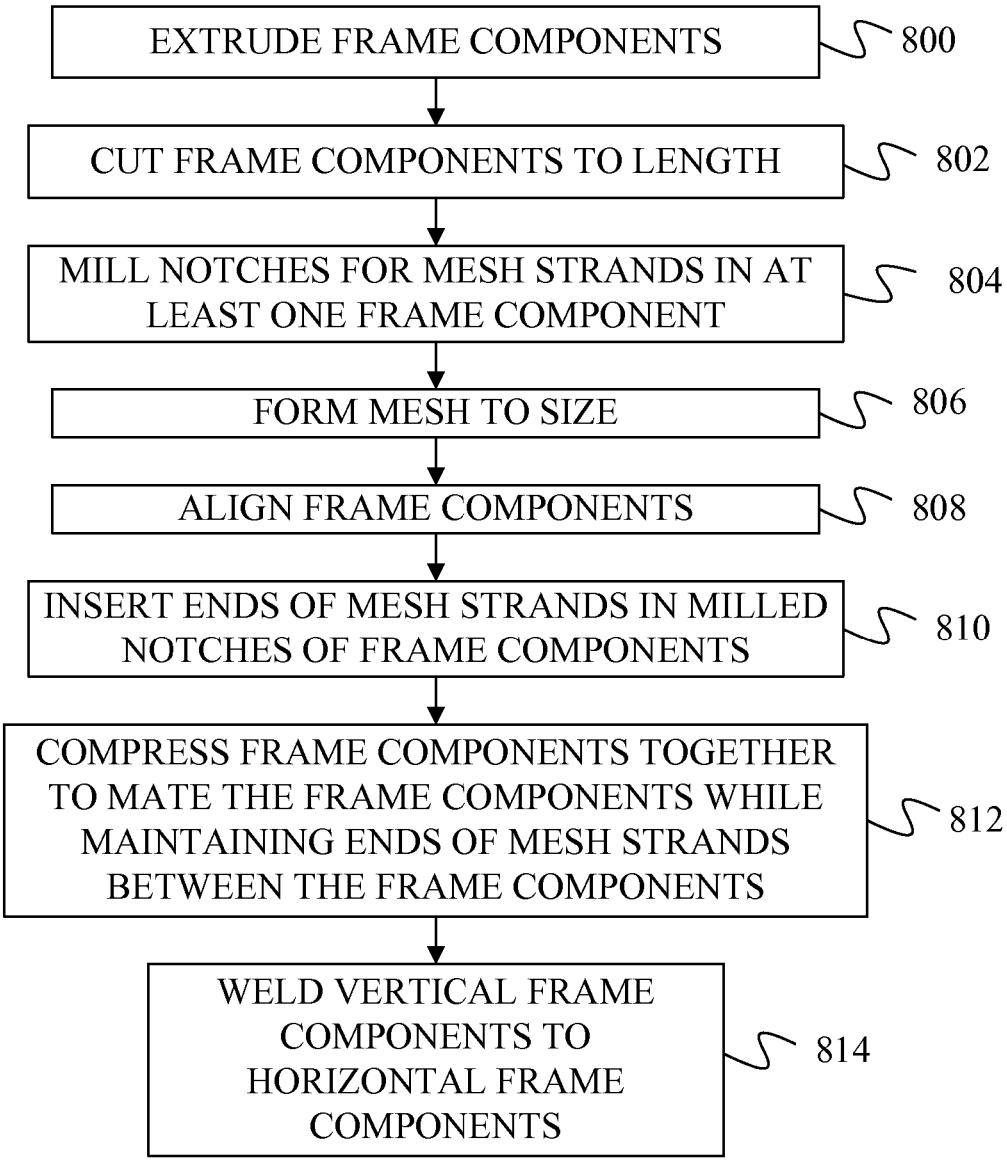
FIG. 8 is a flow diagram for forming a framed mesh panel.

FIG. 8 provides a method of forming a framed mesh. In step 800 of FIG. 8, frame components are extruded through a die to produce the cross-sectional shape shown in FIG. 4 without any notches. Under one embodiment, the frame components are extruded aluminum. In step 802, the frame components are cut to length and notches for the mesh strands are milled or punched into at least one frame component at step 804.

A mesh is then formed to size at step 806 producing a mesh with free strand ends. At step 808, two frame components are aligned by aligning the shaped wall and channel of one of the frame components with the channel and shaped wall of the other frame component. The ends of the strands are then inserted in the milled openings of the frame components at step 810. Note that the order in which steps 808 and 810 are performed may be reversed if desired.

At step 812, the frame components are compressed together to mate or latch the frame components together while maintaining the ends of the mesh strands between the frame components such that the ends of the mesh strands are contained within a chamber defined by the two frame components. Under one embodiment, 1000 pounds per square inch of pressure is used to compress the two frame components together such that the flared portions of the shaped walls move in to the flared cutouts in the respective channels.

Steps 800-812 are performed for each horizontal and each vertical side of the frame. At step 814, the vertical frame components are welded to the horizontal frame components to form the framed mesh.

Figure 9:
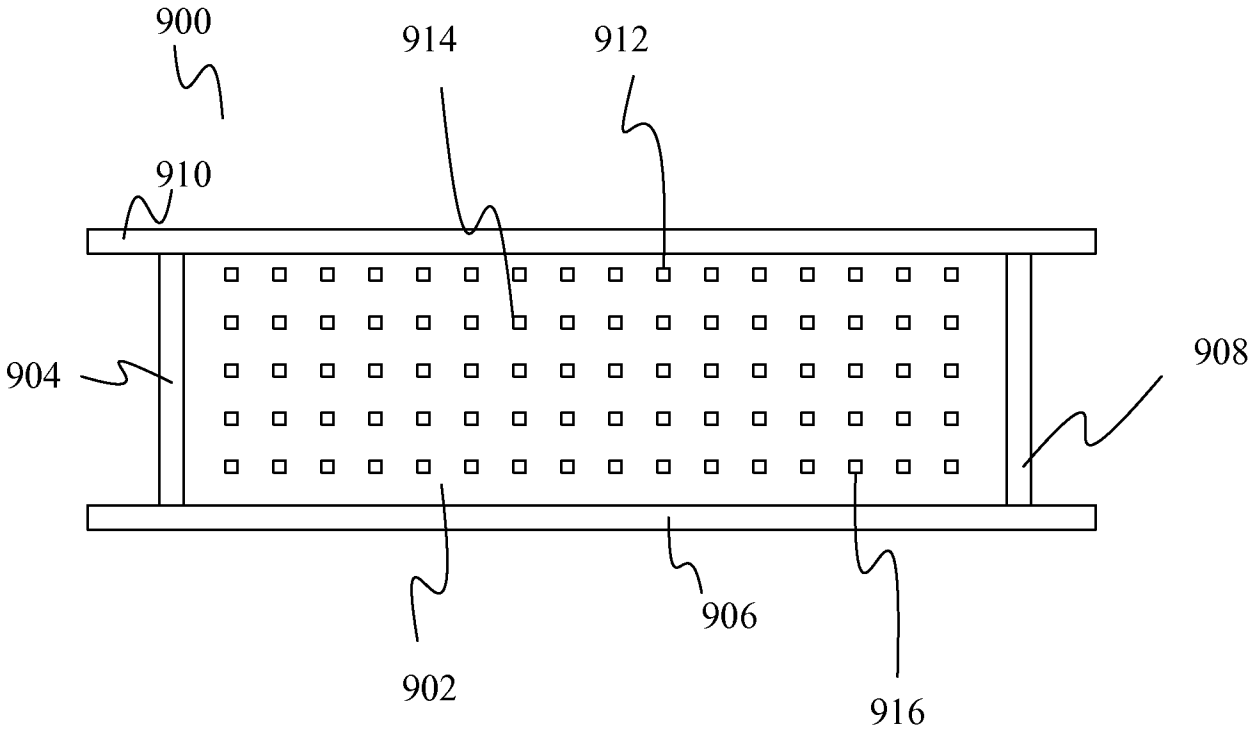
FIG. 9 is a front view of a framed perforated panel under one embodiment.

FIG. 9 provides a front view of a framed perforated panel 900. Framed perforated panel 900 includes perforated panel 902, which is framed by frame members 904, 906, 908, and 910. Perforated panel 902 is a sheet of material with a plurality of perforations such as perforation 912, 914, and 916. Perforated panel 902 is inserted within frame members 904, 906, 908, and 910, and under some embodiments is held in place through frictional contact with one or more of frame members 904, 906, 908, and 910. Under some embodiments, frame members 904 and 908 are welded to frame members 906 and 910.

Figure 10:
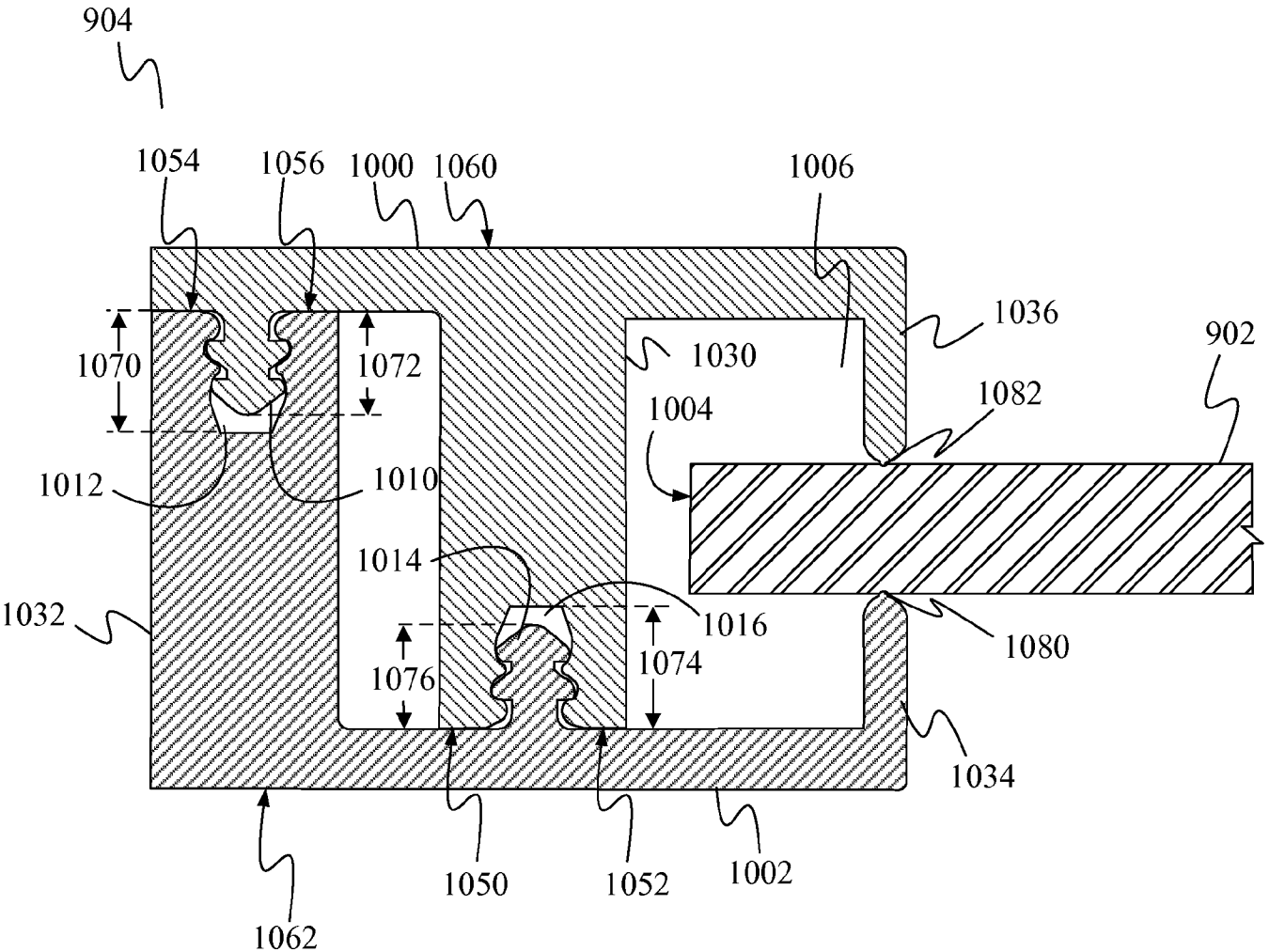
FIG. 10 is a cross-sectional side view of a frame member and panel of the embodiment of FIG. 9.

FIG. 10 provides a cross-sectional side view of frame member 904 and panel 902. Frame member 904 includes front frame component 1000 and back frame component 1002. An end 1004 of panel 902 is located within a chamber 1006 formed between front frame component 1000 and back frame component 1002. Front frame component 1000 is latched to back frame component 1002 through the interaction of a shaped wall or tongue 1010 of front frame component 1000 and the side walls of a channel 1012 of back frame component 1002 as well as the interaction of a shaped wall or tongue 1014 of back frame component 1002 with the side walls defining a channel 1016 in front frame component 1000. Under one embodiment, shaped walls or tongues 1010 and 1014 have a "Christmas tree" cross-sectional shape and channels 1012 and 1016 have "Christmas tree" cut-out shapes. In particular, the channels 1012 and 1016 provide ribbed portions that are in frictional contact with the bottom of flared portions of the shaped tongues or walls 1010 and 1014. The frictional contact between the flared portions and the ribbed portions keep the wall sections within the respective channels, thereby latching front frame component 1000 to back frame component 1002.

Channel 1016 is formed within a strut 1030 and channel 1012 is formed within a strut 1032. The ends 1050 and 1052 of strut 1030 are in direct contact with an interior surface of frame component 1002. Similarly, the ends 1054 and 1056 of strut 1032 are in direct contact with an interior surface of frame component 1000. A lip 1034 of back frame component 1002 and a lip 1036 of front frame component 1000 extend toward each other. Under one embodiment, lips 1034 and 1036 are both in frictional contact with panel 902. Under some embodiments, lips 1034 and 1036 include respective nubs 1080 and 1082 on their ends. Nubs 1080 and 1082 press into panel 902 and/or are crushed by panel 902 as frame components 1000 and 1002 are compressed together to latch shaped walls 1010 and 1014 in respective channels 1012 and 1016.

Frame component 1000 includes an exterior surface 1060 and frame component 1002 includes an exterior surface 1062. Lip 1036, strut 1030, and shaped wall 1010 extend in a direction opposite exterior surface 1060. Lip 1034, strut 1032 and shaped wall 1014 extend in a direction opposite exterior surface 1062. Channel 1012 defined within strut 1032 has a depth 1070 that is at least as great as a height 1072 of the shaped wall 1010. Similarly, channel 1016 defined within strut 1030 has a depth 1074 that is at least as great as a height 1076 of the shaped wall 1014.

Figure 11:
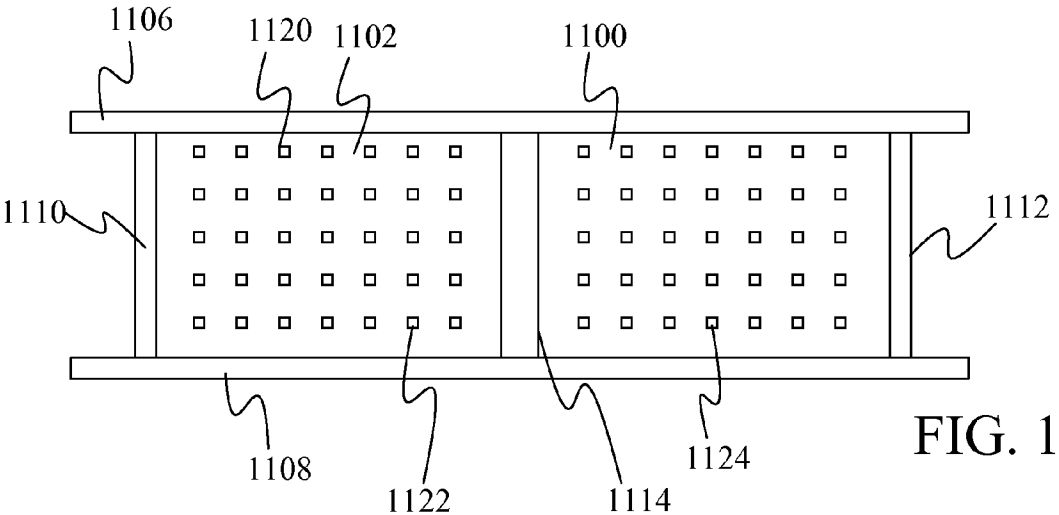
FIG. 11 is a front view of an embodiment of two framed perforated panels with a center frame section.

FIG. 11 is a front view of an embodiment of two framed perforated panels with a center frame member 1114. In FIG. 11, perforated panel 1100 is framed by a portion of top frame member 1106, a portion of bottom frame member 1108, side frame member 1110 and center frame member 1114. Perforated panel 1102 is framed by a portion of top frame member 1106, a portion of bottom frame member 1108, side frame member 1112 and center frame member 1114. Perforated panels 1100 and 1102 are two separate sheets of material, each with a plurality of perforations such as perforation 1120, 1122, and 1124. Perforated panel 1000 is inserted within frame members 1106, 1108, 1110, and 1114, and under some embodiments is held in place through frictional contact with one or more of frame members 1106, 1108, 1110, and 1114. Perforated panel 1002 is inserted within frame members 1106, 1108, 1112, and 1114, and under some embodiments is held in place through frictional contact with one or more of frame members 1106, 1108, 1112, and 1114. Under some embodiments, frame members 1106, and 1108 are welded to frame members 1110, 1112 and 1114.

Figure 12:
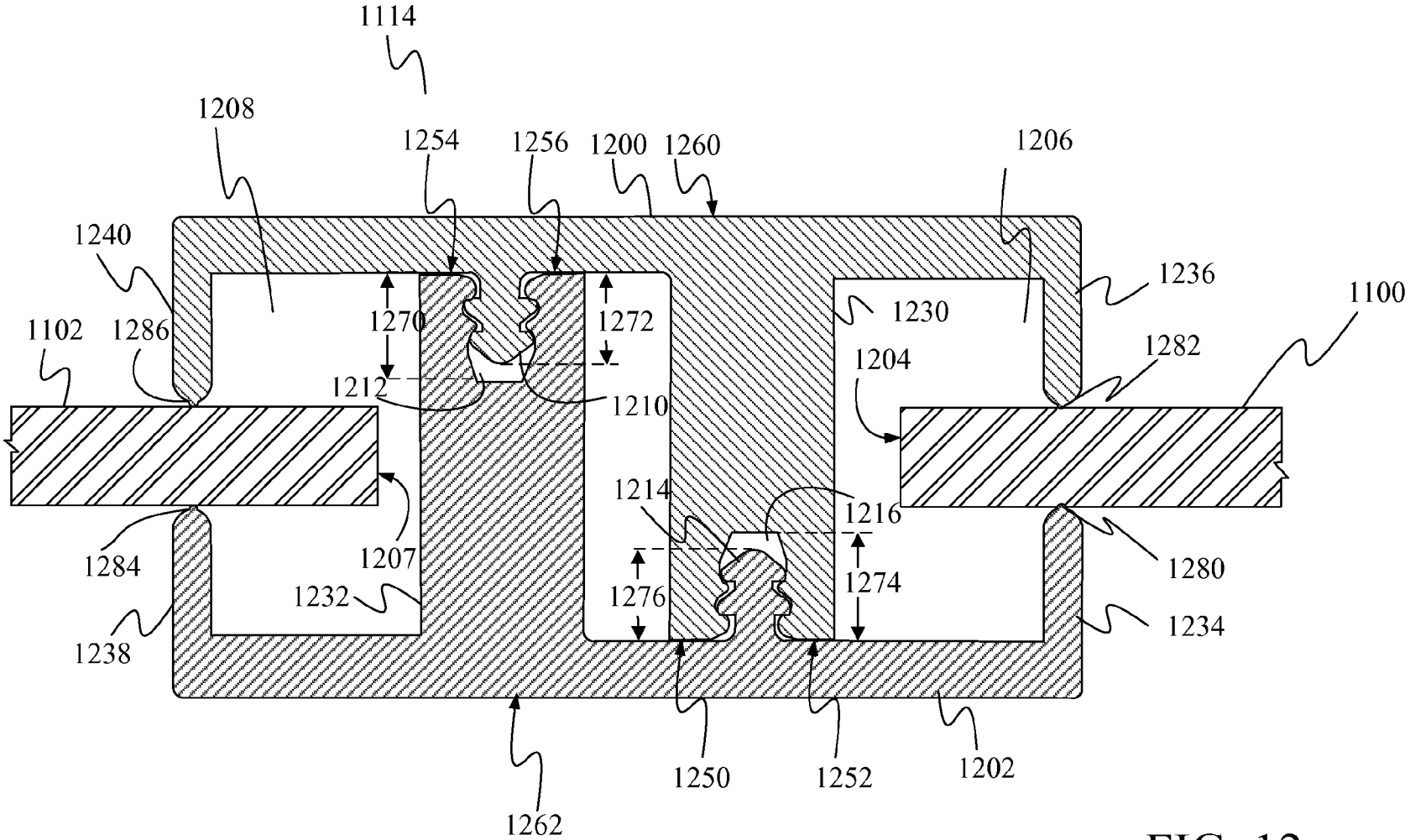
FIG. 12 is a cross-sectional side view of a center frame section with two panels.

FIG. 12 provides a cross-sectional side view of frame member 1114 and panels 1100 and 1102. Frame member 1114 includes front frame component 1200 and back frame component 1202. An end 1204 of panel 1100 is located within a chamber 1206 formed between front frame component 1200 and back frame component 1202. An end 1207 of panel 1102 is located within a chamber 1208 formed between front frame component 1200 and back frame component 1202.

Front frame component 1200 is latched to back frame component 1202 through the interaction of a shaped wall or tongue 1210 of front frame component 1200 with the side walls of a channel 1212 of back frame component 1202 as well as the interaction of a shaped wall or tongue 1214 of back frame component 1202 with the side walls defining a channel 1216 in front frame component 1200. Under one embodiment, shaped walls or tongues 1210 and 1214 have a "Christmas tree" cross-sectional shape and channels 1212 and 1216 have "Christmas tree" cut-out shapes. In particular, the channels 1212 and 1216 provide ribbed portions that are in frictional contact with the bottom of flared portions of the shaped tongues or walls 1210 and 1214. The frictional contact between the flared portions and the ribbed portions keep the wall sections within the respective channels, thereby latching front frame component 1200 to back frame component 1202.

Channel 1216 is formed within a strut 1230 and channel 1212 is formed within a strut 1232. The ends 1250 and 1252 of strut 1230 are in direct contact with an interior surface of frame component 1202. Similarly, the ends 1254 and 1256 of strut 1232 are in direct contact with an interior surface of frame component 1200.

A lip 1234 of back frame component 1202 and a lip 1236 of front frame component 1200 extend toward each other. Under one embodiment, lips 1234 and 1236 are in frictional contact with panel 1100. Under some embodiments, lips 1234 and 1236 include respective nubs 1280 and 1282 on the ends of the lips. Nubs 1280 and 1282 press into panel 1100 and/or are crushed by panel 1100 as frame components 1200 and 1202 are compressed together to latch shaped walls 1210 and 1214 in respective channels 1212 and 1216.

A lip 1238 of back frame component 1202 and a lip 1240 of front frame component 1200 extend toward each other. Under one embodiment, lips 1238 and 1240 are in frictional contact with panel 1102. Under some embodiments, lips 1238 and 1240 include respective nubs 1284 and 1286 on the ends of the lips. Nubs 1284 and 1286 press into panel 1102 and/or are crushed by panel 1102 as frame components 1200 and 1202 are compressed together to latch shaped walls 1210 and 1214 in respective channels 1212 and 1216.

Frame component 1200 includes an exterior surface 1260 and frame component 1202 includes an exterior surface 1262. Lip 1236, lip 1240, strut 1230, and shaped wall 1210 extend in a direction opposite exterior surface 1260. Lip 1234, lip 1238, strut 1232 and shaped wall 1214 extend in a direction opposite exterior surface 1262. Channel 1212 defined within strut 1232 has a depth 1270 that is at least as great as a height 1272 of the shaped wall 1210. Similarly, channel 1216 defined within strut 1230 has a depth 1274 that is at least as great as a height 1276 of the shaped wall 1214.

Under one embodiment, frame component 1200 and frame component 1202 have identical cross-sectional shapes as shown in FIG. 12.

Figure 13:
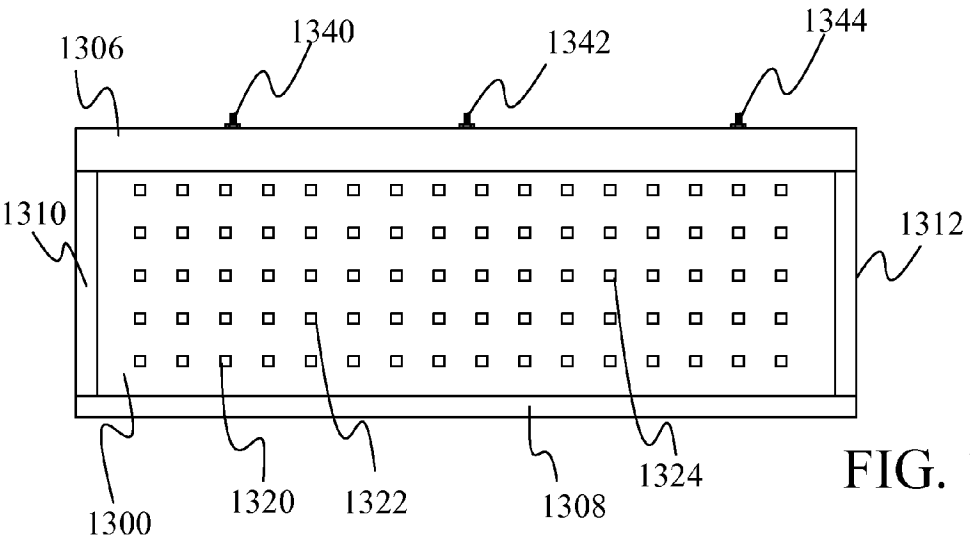
FIG. 13 is a front view of an embodiment of a framed perforated panel with mounting bolts.

FIG. 13 is a front view of an embodiment of a framed panel with mounting hardware extending from a top frame member. In FIG. 13, perforated panel 1300 is framed by top frame member 1306, bottom frame member 1308, side frame member 1310 and side frame member 1312. Perforated panels 1300 is a sheet of material with a plurality of perforations such as perforation 1320, 1322, and 1324. Perforated panel 1300 is inserted within frame members 1306, 1308, 1310, and 1312, and under some embodiments is held in place through frictional contact with one or more of frame members 1306, 1308, 1310, and 1312. Under some embodiments, frame members 1306, and 1308 are welded to frame members 1310 and 1312. Mounting hardware 1340, 1342, and 1344 are inserted within frame 1306 and extend out of frame 1306. Mounting hardware 1340, 1342, and 1344 can be used to mount the framed panel to a wall, ceiling, rail or other structural element.

Figure 14:
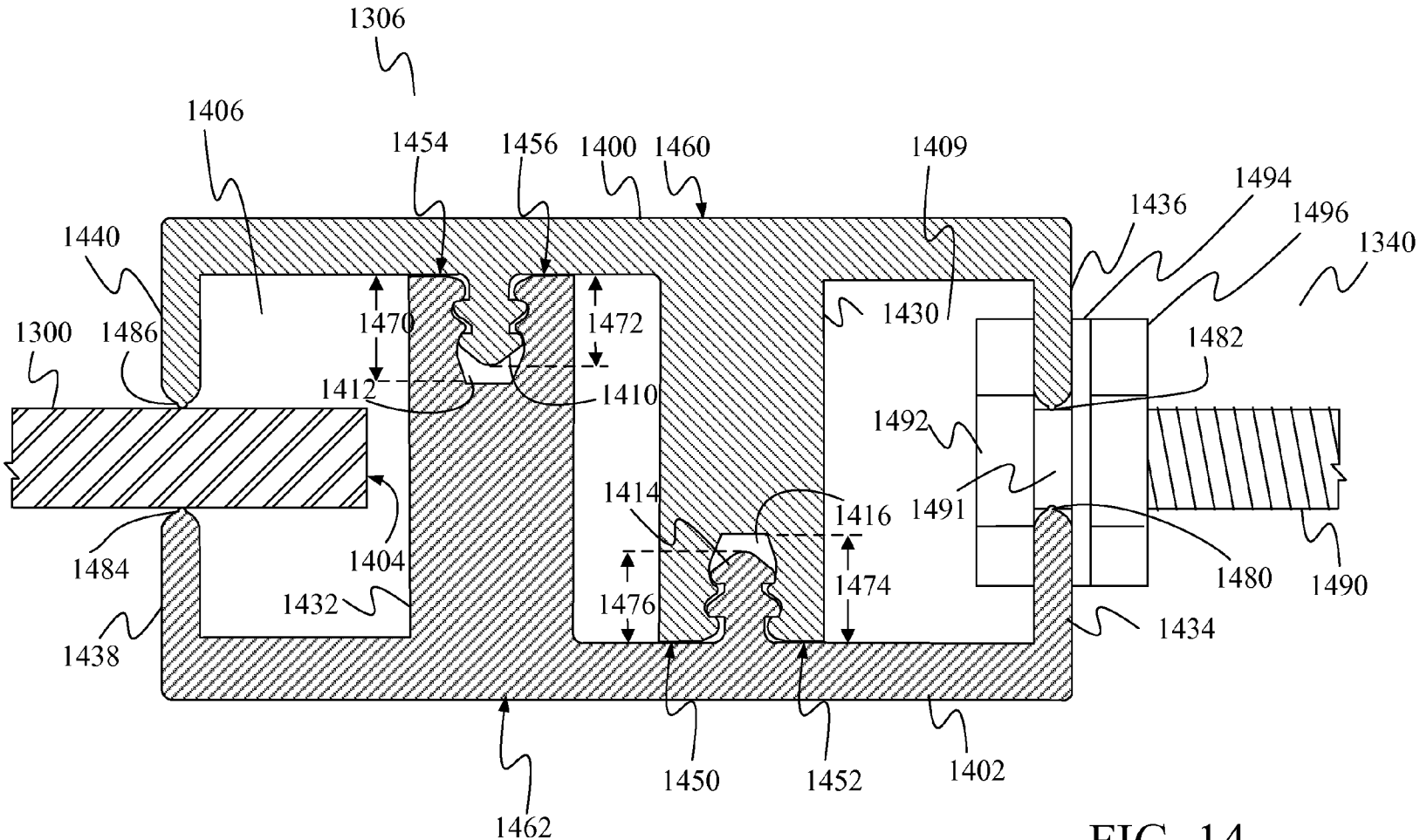
FIG. 14 is a cross-sectional side view of a portion of a frame with a panel and mounting bolts.

FIG. 14 provides a cross-sectional side view of frame member 1306, panel 1300, and mounting hardware 1340. Frame member 1306 includes front frame component 1400 and back frame component 1402. An end 1404 of panel 1300 is located within a chamber 1406 formed between front frame component 1400 and back frame component 1402. In the embodiment of FIG. 14, mounting hardware 1340 comprises a threaded bolt 1490, having a head 1492 positioned within a chamber 1409 formed between front frame component 1400 and back frame component 1402 and a post 1491 extending between and in contact with lip 1434 and lip 1436. A washer 1494 and a nut 1496 are threaded on post 1491 such that head 1492 and washer 1494 press against a lip 1436 of front frame component 1400 and a lip 1434 of back frame component 1402. Bolt 1490 may be any desired length.

Front frame component 1400 is latched to back frame component 1402 through the interaction of a shaped wall or tongue 1410 of front frame component 1400 and the side walls of a channel 1412 of back frame component 1402 as well as the interaction of a shaped wall or tongue 1414 of back frame component 1402 with the side walls defining a channel 1416 in front frame component 1400. Under one embodiment, shaped walls or tongues 1410 and 1414 have a "Christmas tree" cross-sectional shape and channels 1412 and 1416 have "Christmas tree" cut-out shapes. In particular, the channels 1412 and 1416 provide ribbed portions that are in frictional contact with the bottom of flared portions of the shaped tongues or walls 1410 and 1414. The frictional contact between the flared portions and the ribbed portions keep the wall sections within the respective channels, thereby latching front frame component 1400 to back frame component 1402.

Channel 1416 is formed within a strut 1430 and channel 1412 is formed within a strut 1432. The ends 1450 and 1452 of strut 1430 are in direct contact with an interior surface of frame component 1402. Similarly, the ends 1454 and 1456 of strut 1432 are in direct contact with an interior surface of frame component 1400.

Lip 1434 of back frame component 1402 and lip 1436 of front frame component 1400 extend toward each other. Under one embodiment, lips 1434 and 1436 are in frictional contact with panel bolt 1490. Under some embodiments, lips 1434 and 1436 include respective nubs 1480 and 1482 on the ends of the lips. Nubs 1480 and 1482 press into bolt 1490 and/or are crushed by bolt 1490 as frame components 1400 and 1402 are compressed together to latch shaped walls 1410 and 1414 in respective channels 1412 and 1416.

A lip 1438 of back frame component 1402 and a lip 1440 of front frame component 1400 extend toward each other. Under one embodiment, lips 1438 and 1440 are in frictional contact with panel 1300. Under some embodiments, lips 1438 and 1440 include respective nubs 1484 and 1486 on the ends of the lips. Nubs 1484 and 1486 press into panel 1300 and/or are crushed by panel 1300 as frame components 1400 and 1402 are compressed together to latch shaped walls 1410 and 1414 in respective channels 1412 and 1416.

Frame component 1400 includes an exterior surface 1460 and frame component 1402 includes an exterior surface 1462. Lip 1436, lip 1440, strut 1430, and shaped wall 1410 extend in a direction opposite exterior surface 1460. Lip 1434, lip 1438, strut 1432 and shaped wall 1414 extend in a direction opposite exterior surface 1462. Channel 1412 defined within strut 1432 has a depth 1470 that is at least as great as a height 1472 of the shaped wall 1410. Similarly, channel 1416 defined within strut 1430 has a depth 1474 that is at least as great as a height 1476 of the shaped wall 1414.

Under one embodiment, frame component 1400 and frame component 1402 have identical cross-sectional shapes as shown in FIG. 14.

Figure 15:
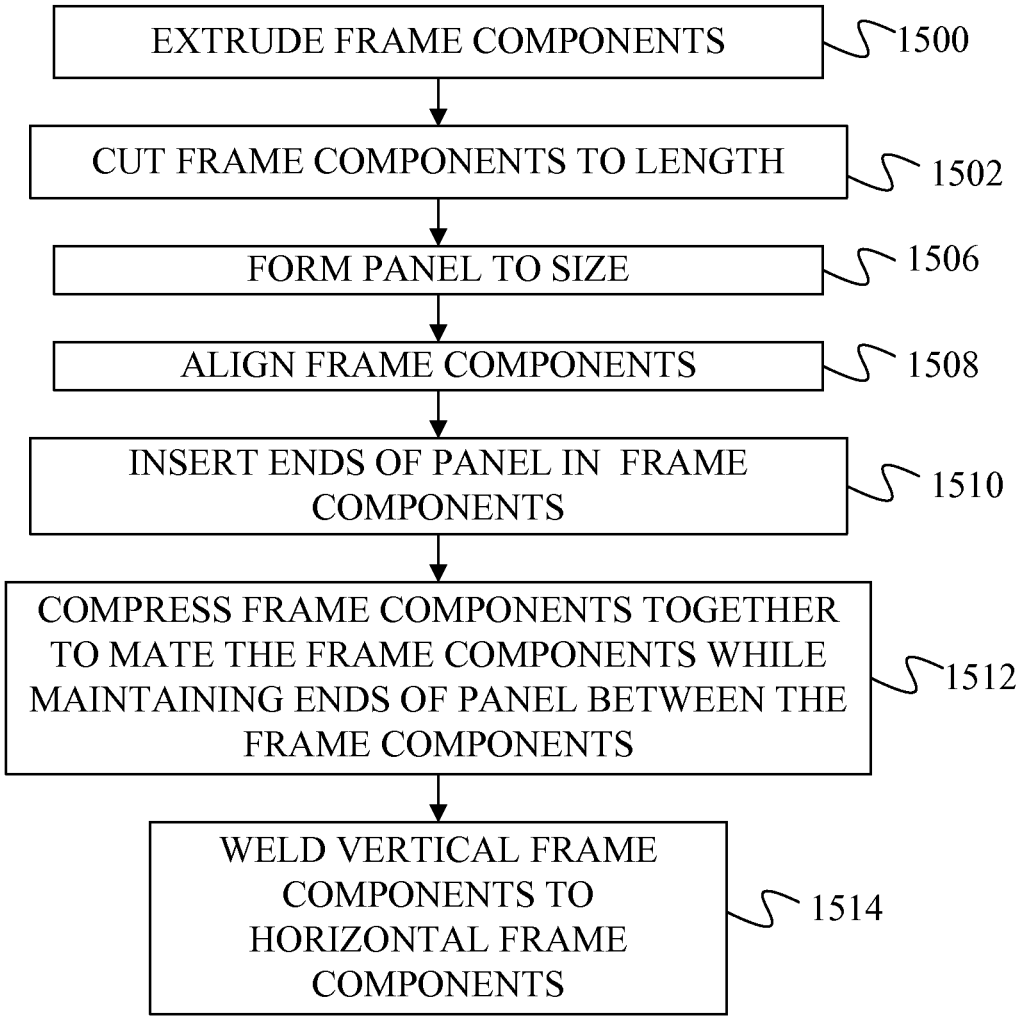
FIG. 15 is a flow diagram for forming a framed panel.

FIG. 15 provides a method of forming a framed panel. In step 1500 of FIG. 15, frame components are extruded through a die to produce the cross-sectional shapes shown in FIG. 10, 12 or 14. Under one embodiment, the frame components are extruded aluminum. In step 1502, the frame components are cut to length.

A panel is then formed to size at step 1506 and at step 1508, two frame components are aligned by aligning the shaped wall and channel of one of the frame components with the channel and shaped wall of the other frame component. The ends of the panel are then inserted in the frame components at step 1510.

At step 1512, the frame components are compressed together to mate or latch the frame components together while maintaining the ends of the panel between the frame components such that the ends of the panel are contained within a chamber defined by the two frame components. Under one embodiment, 1000 pounds per square inch of pressure is used to compress the two frame components together such that the flared portions of the shaped walls move in to the flared cutouts in the respective channels.

Steps 1500-1512 are performed for each horizontal and each vertical portion of the frame as well as any center member of the frame. At step 1514, the vertical frame components are welded to the horizontal frame components to form the framed panel.

Although examples of mesh panels and perforated panels are provided above, the invention is not limited to such panels and other types of panels may be used such as solid panels, for example.

Although the present invention has been described with reference to preferred embodiments, workers skilled in the art will recognize that changes may be made in form and detail without departing from the spirit and scope of the invention.

What is claimed is:

1. A frame comprising:

a first frame component comprising:

a first exterior surface;

a first interior surface;

a first lip extending away from the first interior surface in a direction opposite the first exterior surface;

a first strut having a first channel defined therein, the first strut extending in a direction opposite the first exterior surface; and a first shaped wall positioned between the first lip and the first strut such that the first interior surface extends from the first lip to the first shaped wall and the first shaped wall extends away from the first interior surface in a direction opposite the first exterior surface; and a second frame component comprising:

a second exterior surface;

a second interior surface facing the first interior surface and spaced apart from the first interior surface;

a second lip extending away from the second interior surface toward the first lip, such that the second lip extends toward, is aligned with and is spaced apart from the first lip;

a second shaped wall extending in a direction opposite the second exterior surface; and a second strut positioned between the second shaped wall and the second lip such that the second interior surface extends from the second lip to the second strut, a third interior surface extends between the second strut and the second shaped wall and the second strut extends away from the second interior surface and the third interior surface toward the first interior surface such that an end of the second strut contacts the first interior surface, the second strut having a second channel;

wherein the first shaped wall is positioned within the second channel and the second shaped wall is positioned within the first channel and an end of the first strut contacts the third interior surface.

2. The frame of claim 1 wherein the first lip comprises a first nub on an end of the first lip and the second lip comprises a second nub on an end of the second lip, the first nub extending toward the second nub away from the end of the first lip and the second nub extending toward the first nub away from the end of the second lip.

3. The frame of claim 2 wherein the first nub and the second nub are crushed by a panel between the end of the first lip and the end of the second lip.

4. The frame of claim 3 wherein the first nub and the second nub pierce the panel between the first lip and the second lip.

5. The frame of claim 1 wherein the first shaped wall and the second shaped wall have a cross-sectional shape with flared portions on both sides of the cross-sectional shape.

6. The frame of claim 5 wherein the first channel and the second channel have a cut-out shape with ribbed portions on both sides of the cut-out shape.

7. The frame of claim 6 wherein the ribbed portions of the first channel interact with the flared portions of the second shaped wall to lock the first frame component to the second frame component.

8. The frame of claim 1 wherein the first frame component further comprises a third lip extending in a direction opposite the first exterior surface wherein the first strut is positioned between the third lip and the first shaped wall.

9. The frame of claim 8 wherein the second frame component further comprises a fourth lip extending in a direction opposite the second exterior surface wherein the second shaped wall is positioned between the fourth lip and the second strut.

10. An apparatus comprising:

a first frame component comprising a first lip, a first shaped wall, a first interior surface between the first lip and the first shaped wall and a first strut having defined therein a first channel;

a second frame component comprising a second lip, a second shaped wall, a second strut having defined therein a second channel, and a second interior surface between the second shaped wall and the second strut, wherein the first frame component is mated to the second frame component with the first shaped wall of the first frame component inserted in the second channel of the second frame component such that an end of the second strut contacts the first interior surface and the second shaped wall of the second frame component inserted in the first channel of the first frame component such that an end of the first strut contacts the second interior surface, wherein the first lip and the second lip extend toward each other, are aligned with each other and are spaced apart from each other such that the first frame component and the second frame component forming a chamber between the second strut and the first lip and the second lip; and a panel wherein a portion of the panel extends between and is in contact with the first lip and the second lip such that an end of the panel is positioned in the chamber.

11. The apparatus of claim 10 wherein:

the first frame component further comprises a third lip;

the second frame component further comprises a fourth lip;

the first and second frame component further forming a second chamber between the first strut and the third lip and the fourth lip.

12. The apparatus of claim 11 further comprising a second panel having a portion that extends between and is in contact with the third lip and the fourth lip such than an end of the second panel is positioned in the second chamber.

13. The apparatus of claim 10 wherein the first channel and the second channel each comprise two opposing ribbed walls.

14. The frame of claim 1 wherein the first shaped wall comprises at least four flared portions.

* * * * *